US010087054B2

(12) United States Patent
Yang

(10) Patent No.: US 10,087,054 B2
(45) Date of Patent: Oct. 2, 2018

(54) ROPE WINDER, PETROLEUM INSTRUMENT SALVAGING SYSTEM AND PETROLEUM INSTRUMENT HOISTING SYSTEM

(71) Applicant: Beijing Hailan Science & Technology Development Co., Ltd., Beijing (CN)

(72) Inventor: Biao Yang, Beijing (CN)

(73) Assignee: Beijing Hailan Science & Technology Development Co., Ltd., Beijing (CN)

( * ) Notice: Subject to any disclaimer, the term of this patent is extended or adjusted under 35 U.S.C. 154(b) by 261 days.

(21) Appl. No.: 14/919,640

(22) Filed: Oct. 21, 2015

(65) Prior Publication Data

US 2016/0115754 A1 Apr. 28, 2016

(30) Foreign Application Priority Data

Oct. 23, 2014 (CN) ..... 2014 1 0574987

(51) Int. Cl.

| | |
|---|---|
| ***E21B 23/14*** | (2006.01) |
| ***B66D 1/48*** | (2006.01) |
| ***E21B 19/22*** | (2006.01) |
| ***B66D 1/12*** | (2006.01) |
| ***B66D 1/20*** | (2006.01) |
| ***B66D 1/28*** | (2006.01) |
| ***B66D 1/38*** | (2006.01) |
| ***B66D 5/08*** | (2006.01) |

(52) U.S. Cl.

CPC ..... *B66D 1/485* (2013.01); *B66D 1/12* (2013.01); *B66D 1/20* (2013.01); *B66D 1/28* (2013.01); *B66D 1/38* (2013.01); *B66D 5/08* (2013.01); *E21B 19/22* (2013.01)

(58) Field of Classification Search

CPC ..... E21B 19/22; B66D 1/485; B66D 1/12; B66D 1/20; B66D 1/28; B66D 1/38; B66D 5/08

USPC ..... 166/53

See application file for complete search history.

(56) References Cited

U.S. PATENT DOCUMENTS

| | | | | |
|---|---|---|---|---|
| 3,507,478 A * | 4/1970 | Lewis | B66D 1/7415 254/275 |
| 2003/0159833 A1 | 8/2003 | Sredensek et al. | |
| 2008/0006805 A1* | 1/2008 | Hamilton | B66D 5/08 254/347 |
| 2009/0260797 A1* | 10/2009 | Doud | E21B 19/10 166/53 |

(Continued)

FOREIGN PATENT DOCUMENTS

| | | |
|---|---|---|
| CN | 1051606 A | 5/1991 |
| CN | 201943611 U | 8/2011 |

(Continued)

*Primary Examiner* — Taras P Bemko

(74) *Attorney, Agent, or Firm* — Foley & Lardner LLP

(57) ABSTRACT

A rope winder, which has a rack, and a winding drum set on the rack that releases and retracts a rope. The rope includes a first turning wheel, an electronic counter, a calculating unit, a speed regulating unit and a control unit. The turning wheel has a groove which fits the rope. A petroleum instrument salvaging system which includes the rope winder and rope. One end of the rope is wound on the winding drum of the rope winder. A petroleum instrument hoisting system which includes the rope winder and a rope of which one end is wound on a winding drum of the rope winder.

7 Claims, 5 Drawing Sheets

(56) References Cited

U.S. PATENT DOCUMENTS

2013/0193391 A1* 8/2013 Fok ..... B66D 1/38
254/266

FOREIGN PATENT DOCUMENTS

| | | | |
|---|---|---|---|
| CN | 202321828 | U | 7/2012 |
| CN | 102678077 | A | 9/2012 |
| CN | 102718093 | A | 10/2012 |
| CN | 202808032 | U | 3/2013 |
| CN | 203652921 | U | 6/2014 |
| CN | 104310124 | A | 1/2015 |

* cited by examiner

ROPE WINDER, PETROLEUM INSTRUMENT SALVAGING SYSTEM AND PETROLEUM INSTRUMENT HOISTING SYSTEM

CROSS-REFERENCE TO RELATED APPLICATION

The present application claims priority of Chinese Patent Application No. 201410574987.8, filed Oct. 23, 2014, the content of which is incorporated herein by reference in its entirety.

FIELD OF THE INVENTION

The present invention relates to the technical field of petroleum instruments, and in particular, to a rope winder, and a petroleum instrument salvaging system and a petroleum instrument hoisting system with the above rope winder.

BACKGROUND OF THE INVENTION

During petroleum drilling, as the drill rod of a drilling device strikes into the earth gradually, a petroleum instrument (for example, inclinometer) set in the chamber of the drill rod will transmit the detected data to the ground successively, thereby the subsequent processing on the detected data may be realized by a ground device. The above detected data include the depth data of the petroleum instrument from the ground. As the drilling depth increases gradually, the position of the petroleum instrument will be deeper and deeper. It is known that the environment inside a drilling well is severe and it is harmful to the petroleum instrument. Therefore, it often occurs that the petroleum instrument is damaged; correspondingly, it also often occurs that the petroleum instrument is examined and repaired or replaced.

Generally, the petroleum instrument is placed on a base in the chamber of the drill rod. At present, once the petroleum instrument is damaged, it will be required that the drill rods should be pulled out of the drilling well, that is, the drill rods should be salvaged one by one, until the drill rod in which the petroleum instrument exists is salvaged, and then the petroleum instrument is replaced or examined and repaired. After the petroleum instrument is replaced or examined and repaired, it needs to be reinstalled into the corresponding probe, and then each drill rod should be reconnected to successively lower the drill rod into the drilling well. During the above process, the drill rods need to be disassembled and mounted one by one, thus there exist problems of large labor intensity, low efficiency and high cost, etc. Therefore, the present inventor provides a petroleum instrument salvaging system and a petroleum instrument hoisting system in the corresponding patent application. Wherein, by employing the petroleum instrument salvaging system and the petroleum instrument hoisting system, the salvaging and hoisting of a petroleum instrument can be realized respectively, without pulling the drill rods out of the drilling well, thereby the problems of large labor intensity, low efficiency and high cost, etc., in the current mode of pulling the drill rods out of the drilling well may be solved. However, problems still exist during the salvaging or hoisting of a petroleum instrument. The petroleum instrument salvaging system and the petroleum instrument hoisting system both have a rope winding device, for example, a winding machine, for driving the rope to move so as to realize the lifting and salvaging or releasing and hoisting of the petroleum instrument. Generally, the petroleum instrument is located deep under the ground, for example, 3000 m under the ground. When a salvaging head or a hoisting head is driven by a rope of the current rope winding device, accidents tend to occur. Specifically, when the rope drives the salvaging head to lower into the drilling well for salvaging, the rope is released rapidly, the salvaging head moves toward the direction of the petroleum instrument at a large inertia, and it tends to impact and damage the petroleum instrument; when the rope drives the hoisting head, together with the repaired or replaced petroleum instrument, to lower along the drilling well, the rope is released rapidly, and the petroleum instrument moves toward the direction of the mounting base at a large inertia, and the petroleum instrument tends to impact the mounting base and thus be damaged.

SUMMARY OF THE INVENTION

The invention provides a rope winder, thereby solving the current problem of impact and damage caused by too fast rope release during the salvaging or hoisting of a petroleum instrument.

In order to solve the above technical problem, the invention provides the following technical solutions:

A rope winder, for salvaging or hoisting a petroleum instrument via a rope, which includes: a rack, and a winding drum that is set on the rack for releasing and retracting the rope; wherein, the rope winder further includes:

a first turning wheel, which is set on the rack and is located on a rope releasing and retracting line of the winding drum, wherein the wheel rim of the first turning wheel has a first groove, which fits the rope to rotate synchronously as driven by the rope;

an electronic counter, which is connected with the first turning wheel, for obtaining the number of revolutions of the first turning wheel;

a calculating unit, for calculating the release distance and release speed of the rope according to the number of revolutions of the first turning wheel;

a speed regulating unit, for regulating the rotating speed of the winding drum to regulate the release speed; and a first control unit, which is connected with the calculating unit and the speed regulating unit, for controlling the speed regulating unit to regulate the release speed to a preset safe speed when the release distance is greater than or equal to a set safe distance.

Preferably, the above rope winder further includes a second control unit, which is connected with the speed regulating unit and the calculating unit, for regulating the release speed toward the preset safe speed according to a set regulation interval when the release distance is less than the set safe distance and the difference therebetween is less than a set value.

Preferably, in the above rope winder, the rope winder further includes:

a pulling force sensor, which is set on the rack, for being passed through by the rope to detect the pulling force of the rope; and a third control unit, which is connected with the pulling force sensor, for starting the winding drum to rotate in a forward direction or in a backward direction according to the pulling force.

Preferably, in the above rope winder, the rope winder further includes:

a second turning wheel, which is distributed sequentially with the first turning wheel along the running direction of the rope, wherein the wheel rim of the second turning wheel has a second groove, which fits the rope to rotate synchronously as driven by the rope; and a mechanical counter, which is connected with the second turning wheel, for obtaining the number of revolutions of the second turning wheel.

Preferably, in the above rope winder, the rope winder further includes:

a first slideway, which is set on the rack and extends along a line arrangement direction of the winding drum;

a turning wheel mounting base, which is slidably set on the first slideway and can slide under the dragging of the line arrangement of the rope, wherein the first turning wheel and the second turning wheel are mounted on the turning wheel mounting base;

a second slideway, which is set on the rack and is distributed in parallel with the first slideway; and a pulling force sensor mounting base, which is slidably set on the second slideway and can slide under the dragging of the line arrangement of the rope, wherein the pulling force sensor is connected on the pulling force sensor mounting base.

Preferably, in the above rope winder, the rope winder further includes:

a third slideway, which is set on the rack and is distributed in parallel with the first slideway; and an assistant lead-out line base, which is slidably set on the third slideway and set with a lead-out line operating handle, for being passed through by the part of the rope that is located between the winding drum and the first turning wheel.

Preferably, in the above rope winder, the speed regulating unit is a manual brake, and the number of the manual brakes is two, that is, a first manual brake and a second manual brake respectively, wherein the first manual brake and the second manual brake are respectively disposed at the two ends of the winding drum.

Preferably, in the above rope winder, the winding drum is driven by a driving motor via a driving chain, and the central axis of the rack, the central axis of the winding drum and the chain wheel center at the end of the winding drum are collinear.

Based on the rope winder according to the invention, the invention further provides a petroleum instrument salvaging system, which includes a rope winder, a salvaging head, and a rope of which one end is wound on a winding drum of the rope winder and the other end is connected with the salvaging head, wherein the rope winder is any one of the above rope winders.

Based on the rope winder according to the invention, the invention further provides a petroleum instrument hoisting system, which includes a rope winder, a hoisting head, and a rope of which one end is wound on a winding drum of the rope winder and the other end is connected with the hoisting head, wherein the rope winder is any one of the above rope winders.

The operation of the rope winder according to the invention is as follows: the winding drum of the rope winder releases a rope, the first turning wheel rotates as the rope moves, the calculating unit calculates the release distance and the release speed of the rope according to the count of the electronic counter, the first control unit controls the speed regulating unit to regulate the release speed of the rope to a preset safe speed when the release distance is greater than or equal to a set safe distance so that the salvaging head or the hoisting head driven by the rope can be made to approach the target position at a preset safe speed.

In comparison with the background technologies, the rope winder according to the invention can regulate the release speed to a preset safe speed when the release distance of the rope is greater than or equal to a set safe distance so that the salvaging head or the hoisting head driven by the rope can approach the target at a preset safe speed, thereby realizing the salvaging or hoisting of a petroleum instrument and solving the current problem of impact and damage caused by too fast rope release during the salvaging or hoisting of a petroleum instrument.

BRIEF DESCRIPTION OF THE DRAWINGS

In order to more clearly illustrate the technical solutions of the embodiments of the invention, the drawings needed in the description of the embodiments will be briefly introduced below. Apparently, other drawings may also be obtained by one of ordinary skills in the art according to these drawings without creative work.

Figure 1:
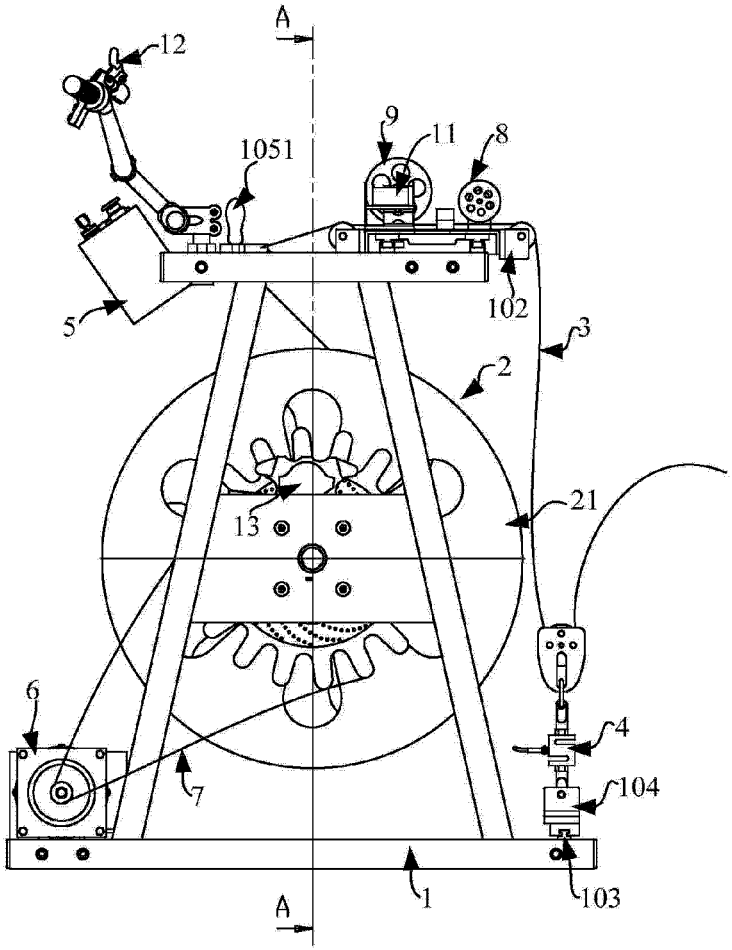
FIG. 1 is a schematic side view showing the structure of a rope winder according to one embodiment of the invention.
Figure 2:
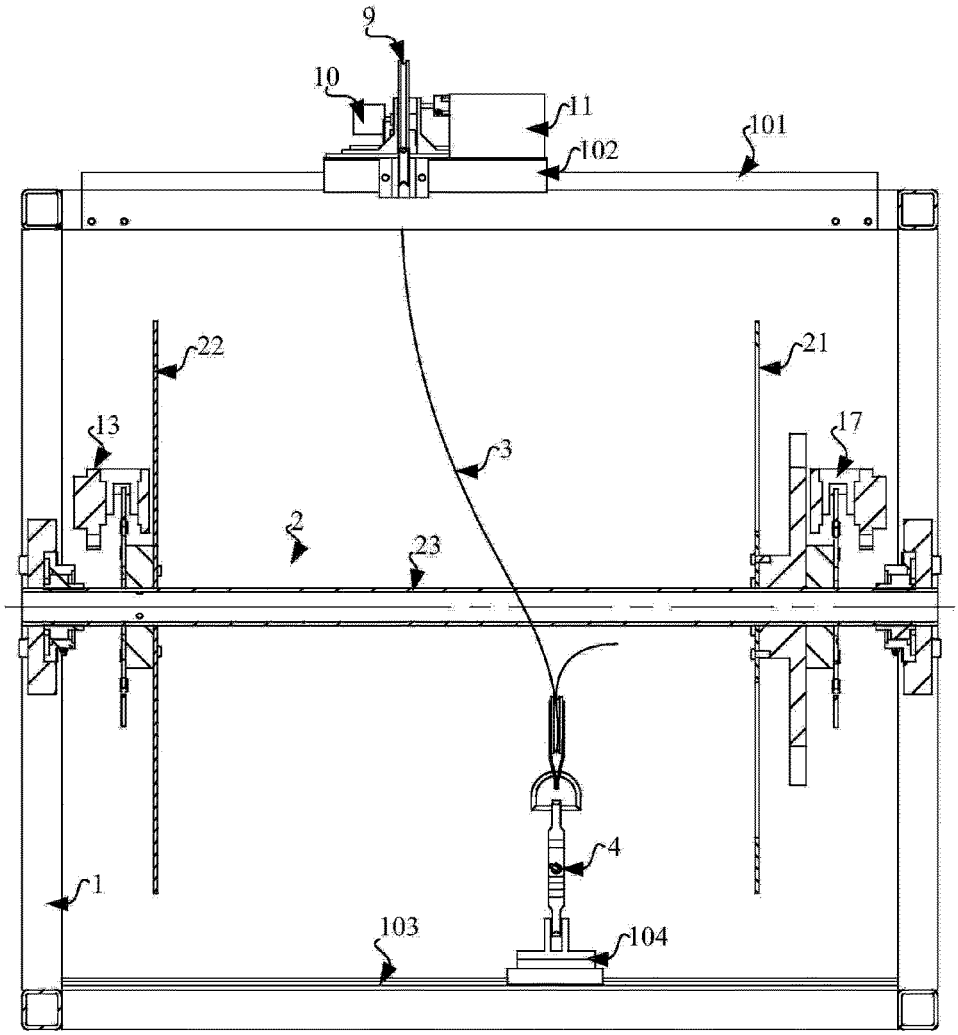
FIG. 2 is a sectional view taken along A-A of FIG. 1.

In the above FIG. 1-FIG. 5:

Rack 1, Winding Drum 2, Rope 3, Pulling Force Sensor 4, Displaying And Operating Platform 5, Driving Motor 6, Driving Chain 7, First Turning Wheel 8, Second Turning Wheel 9, Electronic Counter 10, Mechanical Counter 11, First Manual Brake Operating Handle 12, First Manual Brake 13, Pulley Block 14, Petroleum Instrument 15, Drilling Well 16, Second Manual Brake 17, Second Manual Brake Operating Handle 18, End Plate 21, End Plate 22, Winding Shaft 23;

First Slideway 101, Turning Wheel Mounting Base 102, Second Slideway 103, Pulling Force Sensor Mounting Base 104, Assistant Lead-Out Line Base 105, Third Slideway 106, Lead-Out Line Operating Handle 1051.

DETAILED DESCRIPTION OF THE EMBODIMENTS

One embodiment of the invention provides a rope winder, thereby solving the current problem of impact and damage caused by too fast rope release during the salvaging or hoisting of a petroleum instrument.

In order to make one skilled in the art better understand the technical solutions in the embodiments of the invention and to make the above objects, characteristics and advantages of the embodiments of the invention more apparent, the technical solutions in the embodiments of the invention will be further illustrated in detail in conjunction with the drawings.

One embodiment of the invention provides a rope winder, for salvaging or hoisting a petroleum instrument via a rope 3. Specifically, the rope winder provided is used for manipulating the release and retract of the rope 3, thereby controlling the corresponding operation of the salvaging head of a petroleum instrument salvaging system or the hoisting head of a petroleum instrument hoisting system. Referring to FIGS. 1-4, the rope winder provided includes a rack 1, a winding drum 2, a first turning wheel 8, an electronic counter 10, a calculating unit, a speed regulating unit and a first control unit.

Wherein, the rack 1 is the mounting base of other components of the whole rope winder. Because the rope winder according to the embodiment of the invention is used for salvaging or hoisting a petroleum instrument under a drilling well, strict strength requirements are laid on the rack 1. In the embodiment of the invention, the rack 1 is made of a material with high strength, for example, it is assembled by aluminium alloy (for example, aluminium profiles), steel piece or iron piece via welding or via connecting pieces. In the embodiments of the invention, the specific shape, assembling mode or the specific material of the rack 1 will not be limited.

The winding drum 2 is used for winding the rope 3. The releasing and retracting of the rope 3 can be realized by the forward rotation or the backward rotation of the winding drum 2. It should be noted that, here, the forward rotation refers to that the winding drum 2 rotates in the direction by which the rope 3 release to the drilling well, and the backward rotation is opposite to the direction of forward rotation, and the backward rotation of the winding drum 2 can realize the winding and retracting of the rope 3. The winding drum 2 may have various types and structures, so long as the rope 3 can be wound thereon, and it is not limited in the embodiments of the invention. Referring again to FIG. 4, it shows a winding drum 2 with a specific structure, and the winding drum 2 shown includes two end plates (end plate 21 and end plate 22) and a winding shaft 23 located between the two end plates (end plate 21 and end plate 22), and a winding space is formed between the two end plates (end plate 21 and end plate 22) and the winding shaft 23. The two ends of the winding shaft 23 respectively pass through the corresponding end plate and fit the rack 1 via a bearing component, thus it may guarantee that the whole winding drum 2 can perform releasing and retracting rotation relative to the rack 1. In order to increase the rope winding capability of the winding drum 2, the above end plate 21, end plate 22 and winding shaft 23 are all made of materials with high strength. For example, the winding shaft 23 is a titanium alloy tube. By employing a titanium alloy tube, the strength can be improved, and at the same, the diameter of the winding shaft 23 can be reduced, thereby the winding space can be widened for winding a longer rope 3.

Referring again to FIG. 1, 3 or 4, in the embodiment of the invention, the winding drum 2 is driven by a driving motor 6 to rotate via a driving chain 7. However, the winding drum 2 may also be driven by other driving devices such as a driving motor, etc., and the specific type of the driving device will not be limited in the embodiments of the invention. However, the driving device may also be driven in other types of driving modes such as belt drive and gear drive, etc., rather than being limited to the driving chain 7.

The first turning wheel 8 is set on the rack 1 and is located on a rope releasing and retracting line of the winding drum 2. The wheel rim of the first turning wheel 8 has a first groove, which can fit the rope 3 that is wound to the winding drum 2 or released from the winding drum 2 and can rotate synchronously as driven by the rope 3. The rope 3 moves under the action of the rope winder, thereby the first turning wheel 8 is driven to rotate synchronously by the friction force with the first groove. It should be noted that, in the embodiment of the invention, the synchronous rotation of the first turning wheel 8 with the rope 3 refers to that the distance the rope 3 moves in the unit time equals to the distance swept over by the wheel rim corresponding to the rotation angle of the first turning wheel 8 in the unit time, that is, no relative movement exists between the first groove and the rope 3.

The electronic counter 10 is connected with the first turning wheel 8, for obtaining the number of revolutions of the first turning wheel 8. The calculating unit is connected with the electronic counter 10, for calculating the release distance and release speed of the rope 3 according to the number of revolutions of the first turning wheel 8. It is known that, the perimeter of the wheel rim of the first turning wheel 8 is definite, thus the distance swept over by the wheel rim of the first turning wheel 8 in a set time range, that is, the release distance or lifting distance of the rope 3, may be calculated according to the number of revolutions of the first turning wheel 8 in the set time range. Of course, the release speed or lifting speed of the rope 3 in the set time range may also be calculated. During the salvaging or hoisting of a petroleum instrument, impact and damage tend to occur when the rope 3 is released. Therefore, the calculating unit may only calculate the release distance and release speed of the rope 3.

Referring again to FIGS. 1, 3 and 4, the rope winder according to the embodiment of the invention further includes a displaying and operating platform 5. The displaying and operating platform 5 is used for displaying the calculation result of the calculating unit and other parameters (for example, the result of the electronic counter 10), which is convenient for an operator to monitor and operate.

The speed regulating unit is used for regulating the rotating speed of the winding drum 2 and thus regulating the release speed of the rope 3. The first control unit is connected with the calculating unit and the speed regulating unit, for controlling the speed regulating unit to regulate the release speed to a preset safe speed when the release distance of the rope 3 is greater than or equal to a set safe distance. In the embodiment of the invention, the speed regulating unit may be a manual brake or a hydraulic brake, etc., and the specific type of the speed regulating unit is not limited in the embodiment of the invention. When the speed regulating unit is a manually-controlled brake such as a manual brake, etc., the first control unit of the rope winder according to the embodiment of the invention will be a manual brake operating handle. Referring again to FIG. 4, in a preferred solution of the embodiment of the invention, the number of the manual brakes is two, that is, the first manual brake 13 and the second manual brake 17 respectively, wherein the first manual brake 13 and the second manual brake 17 are respectively set on the two ends of the winding drum 2. Correspondingly, the number of the manual brake operating handles is also two, that is, the first manual brake operating handle 12 and the second manual brake operating handle 18 respectively. The setting of two manual brakes can attain the object of balanced braking.

More preferably, the central axis of the rack 1, the central axis of the winding drum 2 and the chain wheel center at the end of the winding drum 2 are collinear. By such an arrangement, the volume of the whole rope winder can be reduced, and the structure will be more compact.

The operation of the rope winder according to the embodiment of the invention is as follows: the winding drum 2 of the rope winder releases the rope 3, the first turning wheel 8 rotates as the rope 3 moves, the calculating unit calculates the release distance and the release speed of the rope 3 according to the count of the electronic counter 10, the first control unit controls the speed regulating unit to regulate the release speed of the rope 3 to a preset safe speed when the release distance is greater than or equal to a set safe distance so that the salvaging head or the hoisting head driven by the rope 3 can be made to approach the target position at a preset safe speed. It should be noted that, the set safe distance and the preset safe speed are both empirical values obtained by one skilled in the art. Wherein, the set safe distance refers to a release length that is required to be adaptable to change the speed to a preset safe speed, and when it is released to the set safe distance, the release speed has a reliable regulation space. The preset safe speed refers to a release speed that can avoid impact and damage.

In comparison with the background technologies, the rope winder according to the invention can regulate the release speed to a preset safe speed when the release distance of the rope 3 is greater than or equal to a set safe distance so that the salvaging head or the hoisting head driven by the rope 3 can approach the target at a preset safe speed, thereby realizing the salvaging or hoisting of a petroleum instrument and solving the current problem of impact and damage caused by too fast rope release during the salvaging or hoisting of a petroleum instrument.

During an actual hoisting process, because the depth of a drilling well is large, which is generally several kilometers deep into the ground, in order to increase the hoisting efficiency, the rope 3 carrying a hoisting head lowers at a high release speed, and by employing the rope winder according to the embodiment of the invention, the release speed of the rope 3 can be regulated to a preset safe speed when the release distance of the rope 3 is greater than or equal to a set safe distance. It is known that, the petroleum instrument, together with the hoisting head, generally has a large weight, and during the process in which the release speed of the rope 3 is directly regulated to the preset safe speed, a great change of speed will cause a large inertial pulling force to the rope 3, thus it is very likely that the rope 3 is broken, and finally it may cause the hoisting to be failed, or it may even damage the petroleum instrument. In order to solve this problem, the rope winder according to the embodiment of the invention further includes a second control unit, which is connected with both the speed regulating unit and the calculating unit, for regulating the release speed of the rope 3 toward a preset safe speed according to a set regulation interval when the release distance of the rope 3 is less than a set safe distance and the difference therebetween is less than a set value. It should be noted that, the set value is an empirical value generalized by one skilled in the art according to practical hoisting work, and the set value is a positive number greater than zero, and the specific value of the set value will not be limited in the embodiments of the invention. The first control unit properly regulates the release speed of the rope 3 according to a regulation interval, thus the release speed of the rope 3 is made to have a small difference from the preset safe speed when the release distance of the rope 3 is greater than or equal to the set safe distance, thereby the inertia caused by large speed fluctuation can be reduced, and finally the security of hoisting can be improved.

As described above, the depth of the drilling well is large, the petroleum instrument will be at a position deep under the drilling well as the drill rod deeps into the drilling well, and during a salvaging process, the rope 3 lowers the salvaging head into the drilling well, because the salvaging head has a certain weight, it is very difficult for an operator to determine whether the salvaging head hooks on the petroleum instrument, thus a phenomenon of empty hook tends to occur, which will severely influence the salvaging work. In order to solve this problem, the rope winder according to the embodiment of the invention further includes a pulling force sensor 4 and a third control unit. Wherein, the pulling force sensor 4 is set on the rack 1, for being passed through the rope 3 to detect the pulling force of the rope 3. Generally, the pulling force applied to the rope 3 when a salvaging head is carried is different from the pulling force applied to the rope 3 when a salvaging head and a petroleum instrument are carried, thus the pulling force detected by the pulling force sensor 4 may be taken as a reference. The third control unit is connected with the pulling force sensor 4, for driving the winding drum 2 to rotate in a forward direction or in a backward direction according to the pulling force detected by the pulling force sensor. For example, when a salvaging head is solely drawn by the rope 3, the data detected by the pulling force sensor 4 is A, and when a salvaging head and a petroleum instrument are together drawn by the rope 3, the data detected by the pulling force sensor 4 is B (B is greater than A), thus when the pulling force data detected by the pulling force sensor 4 is B, it represents that salvaging is successful, and the third control unit controls the winding drum 2 to rotate in a backward direction, thereby the rope 3 salvages the salvaging head; when the pulling force data detected by the pulling force sensor is A, the third control unit needs to lower the salvaging head to realize the lowering of the salvaging head and the hooking between the salvaging head and the petroleum instrument.

The rope winder according to the embodiment of the invention further includes a second turning wheel 9 and a mechanical counter 11. The second turning wheel 9 is distributed sequentially with the first turning wheel 8 along the running direction of the rope 3, and the wheel rim of the second turning wheel 9 has a second groove; the same as the first groove, the second groove fits the rope 3 and rotates synchronously as driven by the rope 3 under the action of the friction force. It should be noted that, the same as the first turning wheel 8, the synchronous rotation of the second turning wheel 9 with the movement of the rope 3 refers to that the distance the rope 3 moves in the unit time equals to the distance swept over by the wheel rim corresponding to the rotation angle of the first turning wheel 8 in the unit time, that is, no relative movement exists between the second groove and the rope 3. The mechanical counter 11 is used for counting the number of revolutions of the second turning wheel 9. The perimeter of the wheel rim of the second turning wheel 9 is definite, and the operator may substantially determine the release distance of the rope 3 according to the number of revolutions of the second turning wheel 9 displayed by the mechanical counter 11, and the release speed of the rope 3 may be approximately calculated according to the change of the number of revolutions and manual timing, thereby the subsequent control may be performed correspondingly. The above second turning wheel 9 and mechanical counter 11 play a role of dual fail-safe. It is known that, drilling is generally carried out in the open air, lack of electric power often occurs, and once lack of electric power occurs, the electronic counter 10 will be unable to work, thus the mechanical counter 11 and the second turning wheel 9 according to the embodiment of the invention may overcome the above difficulty, so that the dependence on electric power of the whole rope winder may be lowered.

Figure 3:
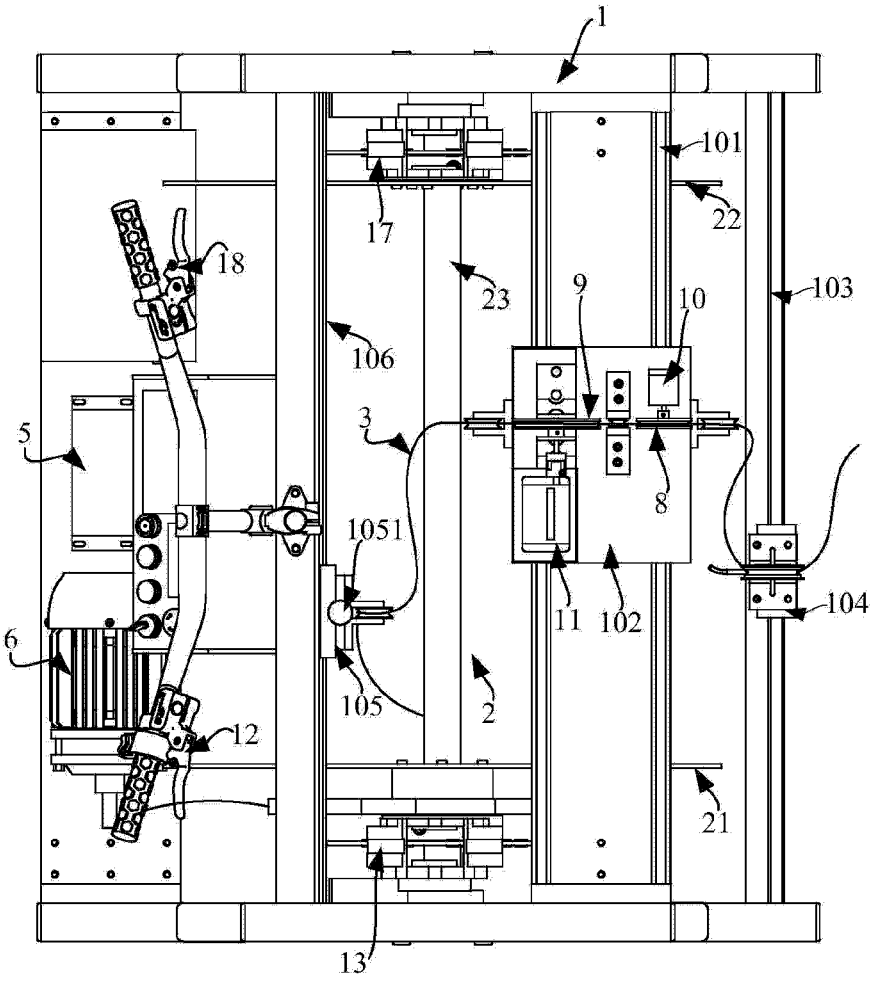
FIG. 3 is a top structural representation of FIG. 1.
Figure 4:
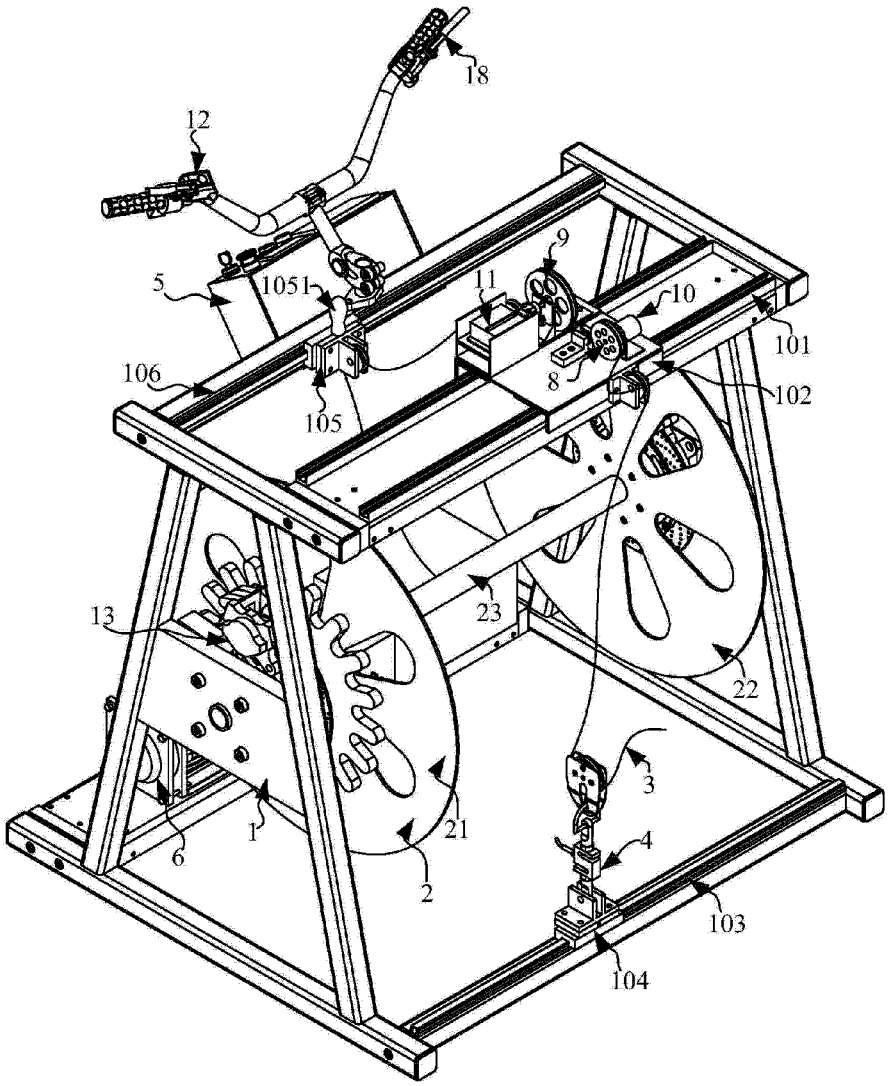
FIG. 4 is a stereoscopic structural representation of a rope winder according to one embodiment of the invention.

Referring to FIG. 3 and FIG. 4, during the actual winding process of the winding drum 2, the rope 3 will generally be wound concentratedly at the central position of the winding drum 2, which will apparently influence the winding amount of the rope 3. Therefore, the rope winder according to the embodiment of the invention includes a first slideway 101, a turning wheel mounting base 102, a second slideway 103 and a pulling force sensor mounting base 104. Wherein, the first slideway 101 is set on the rack 1 and extends along the line arrangement direction of the winding drum 2, the turning wheel mounting base 102 is slidably set on the first slideway 101, and the rope 3 can slide along the first slideway 101 under the dragging of the line arrangement of the winding drum 2, the first turning wheel 8 and the second turning wheel 9 are both mounted on the turning wheel mounting base 102 and are thus able to be adaptively adjusted along the running direction of the rope 3. The second slideway 103 is set on the rack 1, and it is set in parallel with the first slideway 101; the pulling force sensor mounting base 104 is slidably set on the second slideway 103, and it can be adaptively adjusted along the running direction of the rope 3; the pulling force sensor 4 is connected on the pulling force sensor mounting base 104. During the winding of the rope 3, the rope 3 has a pulling force in the line arrangement direction, the turning wheel mounting base 102 and the pulling force sensor mounting base 104 follow up to regulate the position under the action of the pulling force of the line arrangement, thus the rope 3 can be arranged more uniformly. More preferably, the rope winder according to the embodiment of the invention further includes a third slideway 106 and an assistant lead-out line base 105, wherein the third slideway 106 is set on the rack 1 and is distributed in parallel with the first slideway 101, and the assistant lead-out line base 105 is slidably set on the third slideway 106 and set with a lead-out line operating handle 1051, the assistant lead-out line base 105 is used for being passed through by the part of the rope 3 that is located between the winding drum 2 and the first turning wheel 8. When a problem of direction change occurs to the arrangement of the rope 3, the lead-out line operating handle 1051 may be operated manually to change the position of the assistant base 105, thereby assisting to regulate the winding arrangement of the rope 3.

Figure 5:
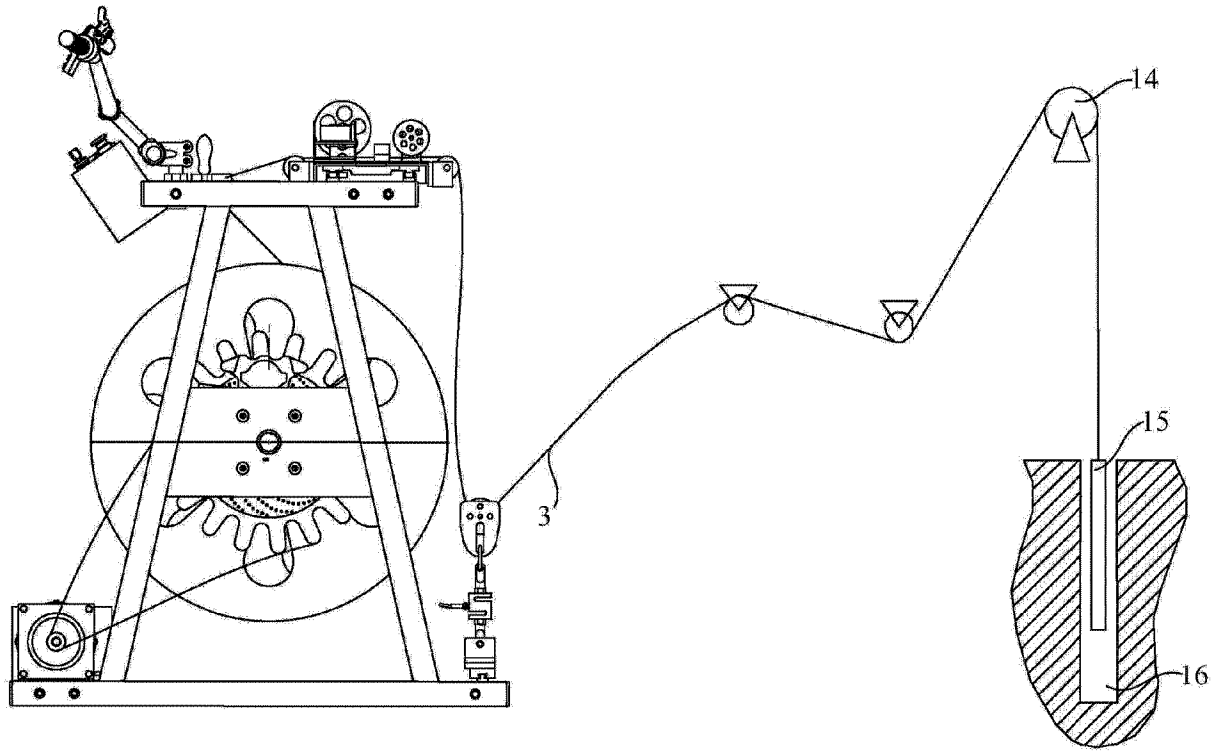
FIG. 5 is a structural representation of a petroleum instrument salvaging system or a petroleum instrument hoisting system according to one embodiment of the invention.

Referring to FIG. 5, based on the rope winder according to the embodiment of the invention, one embodiment of the invention further provides a petroleum instrument salvaging system, for salvaging a petroleum instrument 15 located in a drilling well 16. The petroleum instrument salvaging system provided includes a rope winder, a salvaging head, and a rope 3 of which one end is wound on a winding drum 2 of the rope winder and the other end is connected with the salvaging head. Wherein, the rope winder is any one of the above rope winders according to the embodiments of the invention.

Referring again to FIG. 5, based on the rope winder according to the embodiment of the invention, one embodiment of the invention further provides a petroleum instrument hoisting system, for hoisting a petroleum instrument 15 located in a drilling well 16. The petroleum instrument hoisting system provided includes a rope winder, a hoisting head, and a rope 3 of which one end is wound on a winding drum 2 of the rope winder and the other end is connected with the hoisting head. Wherein, the rope winder is any one of the above rope winders according to the embodiments of the invention.

In the above petroleum instrument salvaging system and petroleum instrument hoisting system, the rope 3 generally changes its strike via a pulley block 14, thereby the releasing and retracting of the rope winder can be realized at different arrangement positions.

During a salvaging process, the rope 3 drives a salvaging head or a hoisting head to rise and fall. Generally, the rope 3 is a steel wire rope; however, the steel wire rope may be knotted, and the fatigue caused by knotting tends to make the rope 3 broken. Once the rope 3 is broken, severe damage will be caused to the drilling device. Therefore, the rope 3 according to the embodiment of the invention is preferably a flexible rope, for example, a nylon rope. The flexible rope has a high strength and a strong flexibility, and it will not be knotted during pulling, thereby the probability that the rope is broken can be lowered. The flexible rope is generally made of a material with high strength and good abrasion resistance, and the specific material of the rope 3 will not be limited in the embodiments of the invention.

It should be noted that, the rope winder, the petroleum instrument salvaging system and the petroleum instrument hoisting system according to the embodiments of the invention may also be applicable for the salvaging of an instrument under a drilling well during the drilling process of other fields, for example, coal drilling, etc., rather than being limited to the field of petroleum.

Each embodiment in this specification is described in a stepped mode, and reference may be made to each other for the same or similar parts among the embodiments. Each embodiment emphasizes a different part from other embodiments.

The above embodiments of the invention will not limit the protection scope of the invention. Any modifications, equivalent substitutions and improvements without departing from the spirit and principle of the invention will fall into the protection scope of the invention.

What is claimed is:

1. A rope winder, for salvaging or hoisting a petroleum instrument via a rope (3), which comprises: a rack (1), and a winding drum (2) that is set on the rack (1) for releasing and retracting the rope (3); wherein, the rope winder further comprises:

a first slideway (101), which is set on the rack (1) and extends along a line arrangement direction of the winding drum (2);

a turning wheel mounting base (102), which is slidably set on the first slideway (101) and can slide under the dragging of the line arrangement of the rope (3);

a first turning wheel (8), which is mounted on the turning wheel mounting base (102) and is located on a rope releasing and retracting line of the winding drum (2), wherein the wheel rim of the first turning wheel (8) has a first groove, which fits the rope (3) to rotate synchronously as driven by the rope (3);

a second slideway (103), which is set on the rack (1) and distributed in parallel with the first slideway (101);

an electronic counter (10), which is connected with the first turning wheel (8), for obtaining the number of revolutions of the first turning wheel (8);

a second turning wheel (9), which is mounted on the turning wheel mounting base (102) and is distributed sequentially with the first turning wheel (8) along the running direction of the rope (3), wherein the wheel rim of the second turning wheel (9) has a second groove, which fits the rope (3) to rotate synchronously as driven by the rope (3);

a mechanical counter (11), which is connected with the second turning when (9), for obtaining the number of revolutions of the second turning wheel (9);

a pulling force sensor (4), which is set on the rack (1), for being passed through by the rope (3) to detect the pulling force of the rope (3);

a pulling force sensor mounting base (104), which is slidably set on the second slideway (103) and can slide under the dragging of the line arrangement of the rope (3), wherein the pulling force sensor (4) is connected on the pulling force sensor mounting base (104);

a calculating unit, for calculating the release distance and release speed of the rope (3) according to the number of revolutions of the first turning wheel (8);

a speed regulating unit, for regulating the rotating speed of the winding drum (2) to regulate the release speed;

a first control unit, which is connected with the calculating unit and the speed regulating unit, for controlling the speed regulating unit to regulate the release speed to a preset safe speed when the release distance is greater than or equal to a set safe distance; and a third control unit, which is connected with the pulling force sensor (4), for starting the winding drum (2) to rotate in a forward direction or in a backward direction according to the pulling force.

2. The rope winder according to claim 1, wherein, the rope winder further comprises a second control unit, which is connected with the speed regulating unit and the calculating unit, for regulating the release speed toward the preset safe speed according to a set regulation interval when the release distance is less than the set safe distance and the difference therebetween is less than a set value.

3. The rope winder according to claim 1, wherein, the rope winder further comprises:

a third slideway (106), which is set on the rack (1) and is distributed in parallel with the first slideway (101); and an assistant lead-out line base (105), which is slidably set on the third slideway (106) and is set with a lead-out line operating handle (1051), for being passed through by the part of the rope (3) located between the winding drum (2) and the first turning wheel (8).

4. The rope winder according to claim 1, wherein, the speed regulating unit is a manual brake, the number of the manual brakes is two, that is, a first manual brake (13) and a second manual brake (17) respectively, wherein, the first manual brake (13) and the second manual brake (17) are respectively disposed on two ends of the winding drum (2).

5. The rope winder according to claim 4, wherein, the winding drum (2) is driven by a driving motor (6) via a driving chain (7), and the central axis of the rack (1), the central axis of the winding drum (2) and the chain wheel center at the end of the winding drum (2) are collinear.

6. A petroleum instrument salvaging system, comprising: a rope winder and a rope (3) of which one end is wound on a winding drum (2) of the rope winder wherein, the rope winder is the rope winder according to any one of claim 1, 2, 3, 4, or 5.

7. A petroleum instrument hoisting system, comprising: a rope winder and a rope (3) of which one end is wound on a winding drum (2) of the rope winder wherein, the rope winder is the rope winder according to any one of claim 1, 2, 3, 4, or 5.

* * * * *